US007415121B2

(12) United States Patent
Mögelin et al.

(10) Patent No.: US 7,415,121 B2
(45) Date of Patent: Aug. 19, 2008

(54) MICROPHONE WITH INTERNAL DAMPING

(75) Inventors: Raymond Mögelin, Alkmaar (NL); Eddy Dubbeldeman, Leiden (NL); Ronald Appel, The Hague (NL)

(73) Assignee: Sonion Nederland B.V., Amsterdam (NL)

( * ) Notice: Subject to any disclaimer, the term of this patent is extended or adjusted under 35 U.S.C. 154(b) by 351 days.

(21) Appl. No.: 10/977,784

(22) Filed: Oct. 29, 2004

(65) Prior Publication Data

US 2006/0093167 A1 May 4, 2006

(51) Int. Cl.
*H04R 25/00* (2006.01)

(52) U.S. Cl. ..... 381/174; 381/369

(58) Field of Classification Search ..... 381/113, 381/116, 173–176, 190, 191, 369, 355–358, 381/189, 360, 409, 410; 367/170, 181; 29/25.41, 29/25.42

See application file for complete search history.

(56) References Cited

U.S. PATENT DOCUMENTS

| | | | | |
|---|---|---|---|---|
| 2,425,481 | A | | 8/1947 | Morse |
| 2,794,862 | A | | 6/1957 | Tøpholm |
| 3,013,127 | A | | 12/1961 | Christensen et al. |
| 3,573,397 | A | | 4/1971 | Sawyer et al. |
| 3,573,400 | A | * | 4/1971 | Sessler et al. ..... 381/357 |
| 3,588,383 | A | | 6/1971 | Carlson et al. |
| 3,742,156 | A | | 6/1973 | Broersma |
| 3,786,202 | A | * | 1/1974 | Schafft ..... 310/324 |
| 3,816,671 | A | * | 6/1974 | Fraim et al. ..... 381/114 |
| 3,935,398 | A | | 1/1976 | Carlson et al. |
| 3,944,756 | A | * | 3/1976 | Lininger ..... 381/355 |
| 3,963,881 | A | * | 6/1976 | Fraim et al. ..... 381/357 |
| 4,109,116 | A | | 8/1978 | Victoreen |
| 4,117,275 | A | | 9/1978 | Miyanaga et al. |
| 4,225,755 | A | * | 9/1980 | Block ..... 381/174 |
| 4,236,051 | A | | 11/1980 | Nakagawa et al. |
| 4,272,654 | A | | 6/1981 | Carlson |
| 4,410,769 | A | | 10/1983 | Tibbetts |
| 4,456,796 | A | * | 6/1984 | Nakagawa et al. ..... 381/191 |
| 4,533,795 | A | | 8/1985 | Baumhauer, Jr. et al. |
| 4,539,441 | A | | 9/1985 | Eggert et al. |
| 4,542,264 | A | | 9/1985 | Schmidt et al. |
| 4,558,184 | A | | 12/1985 | Busch-Vishniac et al. |
| 4,567,382 | A | | 1/1986 | van Halteren |

(Continued)

FOREIGN PATENT DOCUMENTS

| | | |
|---|---|---|
| DE | 2119912 | 3/1974 |

(Continued)

OTHER PUBLICATIONS

European Search Report for Application No. EP 02 07 9037, dated Oct. 16, 2004.

*Primary Examiner*—Huyen D Le
(74) *Attorney, Agent, or Firm*—Nixon Peabody LLP

(57) ABSTRACT

Method and apparatus are disclosed for damping the resonance frequency in a microphone. The method and apparatus of the invention involve providing an elastomeric frame to support the backplate. The elastomeric frame forms a substantially air tight seal around the backplate. A hole is formed in the backplate and a cover having an opening therein is placed over the hole in the backplate. The frequency response of the microphone may then be controlled by precisely controlling the size, shape, and/or location of the opening in the cover overlaying the hole. The cover may also serve as an electrical contact to other components in the microphone.

21 Claims, 3 Drawing Sheets

U.S. PATENT DOCUMENTS 4,607,145 A 8/1986 Ravinet et al.
4,607,383 A 8/1986 Ingalls
4,621,171 A 11/1986 Wada et al.
4,685,137 A 8/1987 Watson et al.
4,691,363 A 9/1987 Khanna
4,697,334 A 10/1987 Madsen et al.
4,701,640 A 10/1987 Flygstad et al.
4,728,934 A 3/1988 Pfänder et al.
4,730,283 A 3/1988 Carlson et al.
4,764,690 A 8/1988 Murphy et al.
4,777,650 A 10/1988 Frederiksen
4,790,021 A 12/1988 Pribyl
4,796,288 A 1/1989 Busche et al.
4,815,138 A 3/1989 Diethelm
4,815,560 A * 3/1989 Madaffari ..... 181/158
4,817,164 A 3/1989 Bertignoll et al.
4,837,833 A 6/1989 Madaffari
4,845,512 A 7/1989 Arway
4,870,688 A 9/1989 Voroba et al.
4,872,148 A 10/1989 Kirby et al.
4,891,843 A 1/1990 Paulus, Jr. et al.
4,910,840 A 3/1990 Sprenkels et al.
4,922,471 A 5/1990 Kuehnel
4,977,590 A 12/1990 Milovancevic
4,993,072 A 2/1991 Murphy
5,014,322 A 5/1991 Yasuda et al.
5,068,901 A 11/1991 Carlson
5,101,543 A 4/1992 Cote et al.
5,255,246 A 10/1993 van Halteren
5,319,717 A 6/1994 Holesha
5,335,210 A 8/1994 Bernstein
5,335,286 A 8/1994 Carlson et al.
5,388,163 A 2/1995 Elko et al.
5,401,914 A 3/1995 Curran et al.
5,408,534 A 4/1995 Lenzini et al.
5,410,608 A 4/1995 Lucey et al.
5,446,413 A 8/1995 Loeppert et al.
5,452,268 A 9/1995 Bernstein
5,490,220 A 2/1996 Loeppert
5,522,123 A 6/1996 Kugo
5,548,658 A 8/1996 Ring et al.
5,570,428 A 10/1996 Madaffari et al.
5,615,273 A 3/1997 Lucey et al.
5,619,476 A 4/1997 Haller et al.
5,673,330 A 9/1997 Chang
5,677,965 A 10/1997 Moret et al.
5,682,075 A 10/1997 Bolleman et al.
5,708,721 A 1/1998 Salvage et al.
5,809,155 A 9/1998 Su
5,861,779 A 1/1999 Loeppert et al.
5,862,239 A 1/1999 Kubli et al.
5,870,351 A 2/1999 Ladabaum et al.
5,875,251 A 2/1999 Sun
5,881,158 A 3/1999 Lesinski et al.
5,889,872 A 3/1999 Sooriakumar et al.
5,894,452 A 4/1999 Ladabaum et al.
5,946,403 A 8/1999 Josephson et al.
5,949,895 A 9/1999 Ball et al.
5,952,645 A 9/1999 Wang et al.
5,970,159 A 10/1999 McIntosh
5,978,491 A 11/1999 Papadopoulos
5,982,709 A 11/1999 Ladabaum et al.
5,982,905 A 11/1999 Grodinsky et al.
5,990,454 A 11/1999 Westerberg et al.
6,011,855 A 1/2000 Selfridge et al.
6,031,922 A 2/2000 Tibbetts
6,044,160 A 3/2000 Norris
6,078,677 A 6/2000 Dolleman et al.
6,169,810 B1 * 1/2001 van Halteren et al. ..... 381/174
6,178,249 B1 1/2001 Hietanen et al.
6,201,876 B1 3/2001 Niemi et al.
6,243,474 B1 6/2001 Tai et al.
6,323,049 B1 11/2001 Lee
6,366,678 B1 4/2002 Madaffari et al.
6,438,243 B1 8/2002 Ikeuchi et al.
6,504,937 B1 1/2003 Papadopoulos et al.
6,532,293 B1 3/2003 Collins
6,549,632 B1 4/2003 Akino et al.
6,580,797 B1 6/2003 Papadopoulos et al.
6,594,369 B1 7/2003 Une
6,597,793 B1 7/2003 Darbut et al.
6,606,389 B1 8/2003 Selfridge et al.
6,614,911 B1 9/2003 Watson et al.
6,647,368 B2 11/2003 Nemirovski
6,671,379 B2 12/2003 Nemirovski
6,677,176 B2 1/2004 Wong et al.
6,684,484 B2 2/2004 Collins
6,694,032 B2 2/2004 Yun et al.
6,704,427 B2 * 3/2004 Kearey ..... 381/355
6,707,920 B2 3/2004 Miller
6,950,529 B2 * 9/2005 Wilmink ..... 381/174
2002/0076076 A1 6/2002 Kay et al.
2002/0172382 A1 * 11/2002 Nakabayashi ..... 381/174
2002/0172389 A1 * 11/2002 Pavlovic ..... 381/369
2003/0021432 A1 1/2003 Scheeper et al.
2003/0063768 A1 * 4/2003 Cornelius et al. ..... 381/369
2003/0076970 A1 * 4/2003 van Halteren et al. ..... 381/191
2003/0081801 A1 * 5/2003 Hohjyo ..... 381/174
2003/0194103 A1 * 10/2003 Kakinuma ..... 381/361
2004/0047486 A1 * 3/2004 Van Doorn et al. ..... 381/355
2004/0086149 A1 * 5/2004 Johannsen et al. ..... 381/412

FOREIGN PATENT DOCUMENTS

EP 0 147 373 11/1984
EP 0 194 958 9/1986
EP 0 326 040 8/1989
EP 0 371 620 6/1990
EP 0 533 284 A1 3/1993
EP 0 499 237 5/1995
EP 0 561 566 9/1995
EP 0 670 602 9/1995
EP 0 664 942 B1 2/1997
EP 0 800 331 A2 10/1997
EP 0 802 700 A1 10/1997
EP 0 969 695 A1 1/2000
EP 1 067 819 7/2000
EP 1 052 880 A2 11/2000
EP 1 100 289 11/2000
JP 59-105800 6/1984
JP 60-074800 4/1985
JP 60-146015 1/1987
JP 10-136492 5/1998
NL 6602799 9/1967
WO WO-84/00662 2/1984
WO WO-84/01683 4/1984
WO WO-88/02208 3/1988
WO WO-95/22879 A2 8/1995
WO WO-98/35530 8/1998
WO WO-01/26413 A2 4/2001
WO WO-01/63970 A2 8/2001
WO WO-01/89264 A1 11/2001

* cited by examiner

MICROPHONE WITH INTERNAL DAMPING

FIELD OF THE INVENTION

The present invention relates to miniature microphones used in listening devices, such as hearing aids. In particular, the present invention relates to a method and apparatus for damping the frequency response in such miniature microphones.

BACKGROUND OF THE INVENTION

A conventional listening device such as a hearing aid includes, among other things, a microphone and a receiver. The microphone receives sound waves and converts the sound waves to an audio signal. The audio signal is then processed (e.g., amplified) and provided to the receiver. The receiver converts the processed audio signal into an acoustic signal and subsequently broadcasts the acoustic signal to the user.

The microphone generally has a rigid, electrically charged backplate and a moveable metallic diaphragm. The diaphragm divides the inner volume of the microphone into a front volume and a rear volume. Sound waves enter the microphone via a sound inlet and pass into the front volume. The air vibrations created by the entering sound waves cause the metallic diaphragm to move, thereby inducing an electric signal in the electrically charged backplate corresponding to the sound waves. The electric signal is then processed by audio processing circuitry connected to the charged backplate and converted into an audio signal.

For certain applications, including hearing aids and other listening devices, it is desirable to dampen the resonance frequency of the microphone system. One way to dampen the frequency response is to increase the inertance presented to the sound waves entering the microphone by placing an obstruction near the sound inlet in the front volume. Common types of obstructions include a damping screen made of a grid-like mesh material placed over the sound inlet, a shaped embossment or structure formed or placed inside the housing of the microphone near the sound inlet, and the like.

A damping screen, however, can become clogged as debris and foreign material accumulate on its surface. As the dampening screen becomes increasingly clogged, the microphone's frequency response may depart from the specification. A shaped structure can also become less effective as debris accumulates, since the shaped structure depends on its shape to create the desired dampening effect. If the accumulated debris alters the shape of the shaped structure, the microphone's frequency response will be altered. In both of the above cases, the accumulation of debris, such as dust, hairspray, pollen, and other particles, may adversely affect the frequency response of the microphone and may even cause it to malfunction.

Unlike the front volume, the rear volume is typically sealed off and largely impervious to debris. Therefore, some microphones place the damping mechanism in the rear volume to avoid debris accumulation. These microphones use a damping frame between the diaphragm and the backplate to dampen the frequency response. The damping frame has inner slits cut into its opposing edges that, together with the backplate, define apertures through which air may escape from the area between the diaphragm and the backplate to the rest of the rear volume. The escaping air results in a damping of the frequency response of the microphone. An example of such a microphone may be found in commonly-owned U.S. Published Application No. 20030063768 to Cornelius et al., which is incorporated herein by reference in its entirety.

The dimensions of the inner slits in the above microphones have to be very precise in order to achieve the desired level of escaping air for damping purposes. Also, the damping frame is normally made of a stiff or rigid material, usually plastic or Kapton®. Moreover, a hole is sometimes punched through the backplate to facilitate handling during assembly of the microphone. This hole has to be subsequently filled (e.g., with adhesive or similar material) in order to prevent air from escaping through the hole. Accordingly, what is needed is an improved way to control the frequency response of the microphone.

SUMMARY OF THE INVENTION

The present invention is directed to a method and apparatus for damping the resonance frequency in a microphone. The method and apparatus of the invention involve providing an elastomeric frame to support the backplate. The elastomeric frame forms a substantially air tight seal around the backplate. A hole is formed in the backplate and a cover having an opening therein is placed over the hole in the backplate. The frequency response of the microphone may then be controlled by precisely controlling the size, shape, and/or location of the opening in the cover overlaying the hole. The cover may also serve as an electrical contact to other components in the microphone.

In general, in one aspect, the invention is directed to a microphone. The microphone comprises a housing, a diaphragm mounted in the housing, and a backplate mounted in the housing at a known location relative to the diaphragm. An electrical-contact element is provided for carrying signals from the backplate, the electrical-contact element providing an acoustic feature for controlling a frequency response of the microphone.

In general, in another aspect, the invention is directed to a method of manufacturing a microphone, the microphone having a housing, a diaphragm, and a backplate. The method comprises the steps of lancing a hole through the backplate and surrounding the backplate with a support frame. The support frame forms a substantially airtight seal around the backplate and keeps the backplate centered over the diaphragm. In one embodiment, the support frame also keeps the backplate substantially parallel to and spaced apart from the diaphragm. The method further comprises the step of covering up the hole in the backplate with a cover, the cover having an interior wall defining an opening of a predetermined size, shape, and/or location to control a frequency response of the microphone.

In general, in yet another aspect, the invention is directed to a mechanism for damping a frequency response of a microphone. The mechanism comprises a backplate mounted in the microphone, the backplate having an inner wall defining a hole through backplate. The mechanism further comprises a cover covering up the hole in the backplate, the cover having an interior wall defining an opening through the cover, the opening having a predetermined size, shape, and/or location for allowing air to escape through the opening.

In general, in still another aspect, the invention is directed to a method of damping a frequency response of a microphone, the microphone having at least a housing, a diaphragm mounted in the housing, and a backplate mounted in the housing at a known location relative to the diaphragm. The method comprises the steps of creating at least one hole through the backplate and covering up the at least one hole with a cover such that at least one opening having a predetermined size, shape, and/or location remains over the at least one hole. The frequency response of the microphone is dampened based on the predetermined size, shape, and/or location of the at least one opening.

In general, in yet another aspect, the invention is directed to a microphone. The microphone comprises a housing, a diaphragm mounted in the housing, and a backplate mounted substantially parallel to and spaced apart from the diaphragm. The backplate has at least one hole through it. A cover covers up the at least one hole in the backplate. The cover has at least one opening through it, the at least one opening having a predetermined size, shape, and/or location to control a frequency response of the microphone.

The above summary of the present invention is not intended to represent each embodiment, or every aspect, of the present invention.

BRIEF DESCRIPTION OF THE DRAWINGS

The foregoing and other advantages of the invention will become apparent upon reading the following detailed description and upon reference to the drawings, wherein.

Figure 1A:
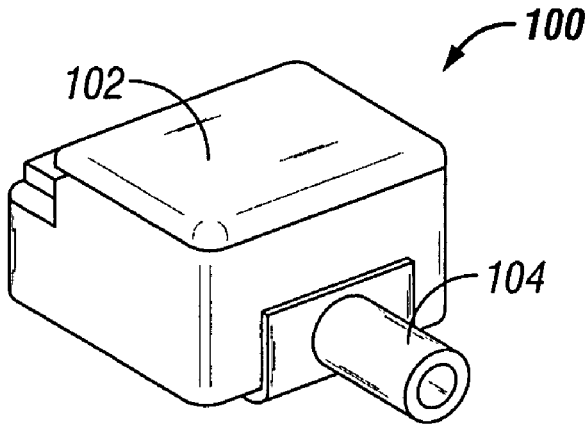
FIG. 1A (Prior Art)
FIGS. 1A and 1B illustrate a prior art microphone.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

As mentioned above, embodiments of the invention provide a method and apparatus for damping the frequency response in a microphone of a listening device, such as a hearing aid. The method and apparatus of the invention makes use of a hole in the backplate by partially covering the hole to control the frequency response. A substantially airtight seal is formed between the backplate and a frame supporting the backplate to prevent air from escaping through the seal.

Figure 1B:
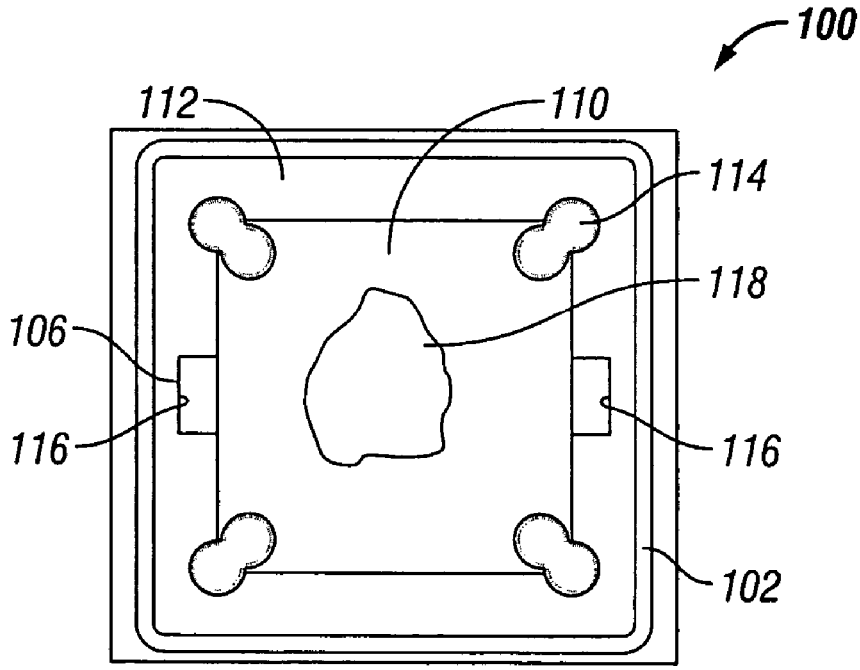
FIG. 1B (Prior Art)

A prior art microphone 100 for a conventional listening device is shown in FIGS. 1A-1B. Referring first to the perspective view of FIG. 1A, the microphone 100 includes a housing 102 that houses the audio components inside the microphone 100. The housing 102 may be of a size and shape that allows the microphone 100 to be used in miniature listening devices, such as hearing aids. A sound inlet 104 in the housing 102 enables sound waves to enter the microphone 100.

FIG. 1B is a top cut away view of the microphone 100 in FIG. 1A, showing a backplate 110 mounted to a damping frame 112. The rigid, electrically charged backplate 110 is, in some cases, attached to the damping frame 112 by drops of cured adhesive 114 at the corners of the backplate 110. Inner slits 106 defined by the recessed areas 116 in the damping frame 112, are cut out of opposing sides of the damping frame 112 to allow the passage of air therethrough for damping purposes. A hole, defined by the inner wall 118 of the backplate 110, is punched near the middle of the backplate 110 to facilitate handling thereof during assembly of the microphone 100. The hole is subsequently filled in with adhesive and the like to prevent air from escaping through the hole.

Figure 2A:
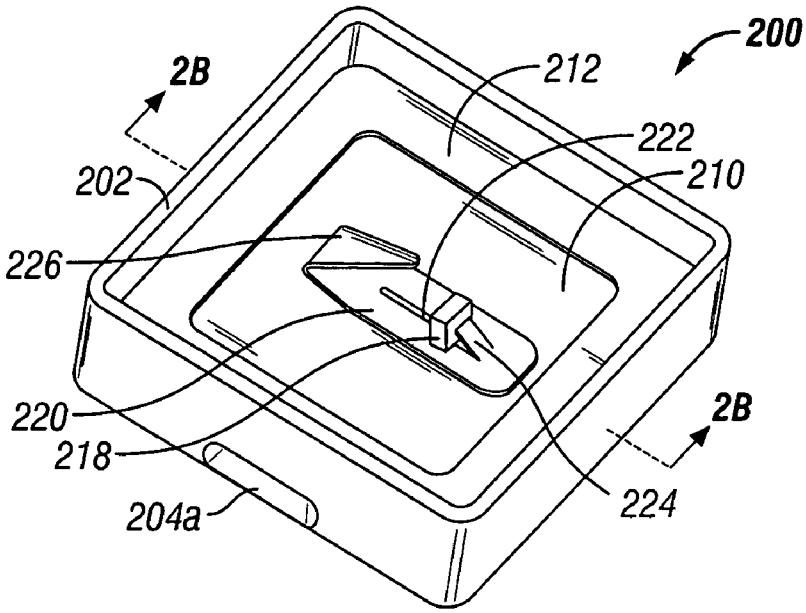
FIGS. 2A-2C illustrate a microphone according to some embodiments of the invention.
Figure 2B:
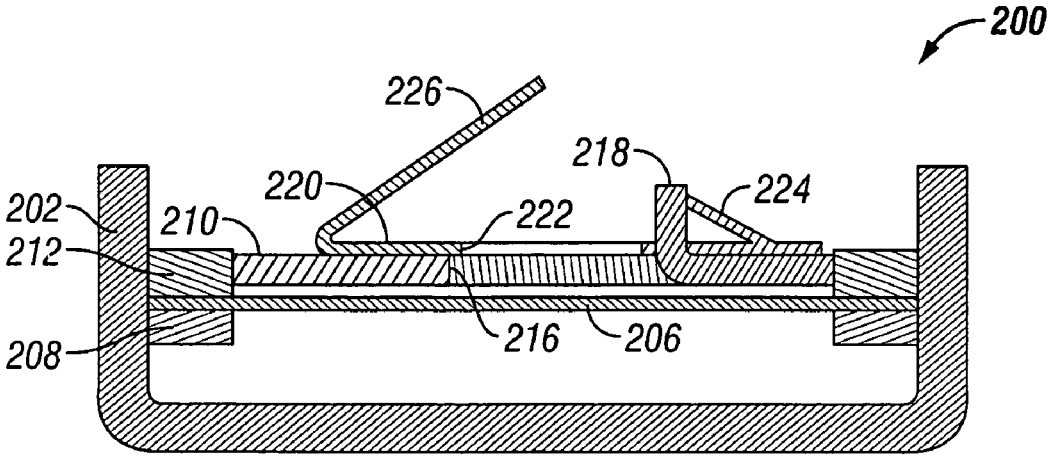
Figure 2C:
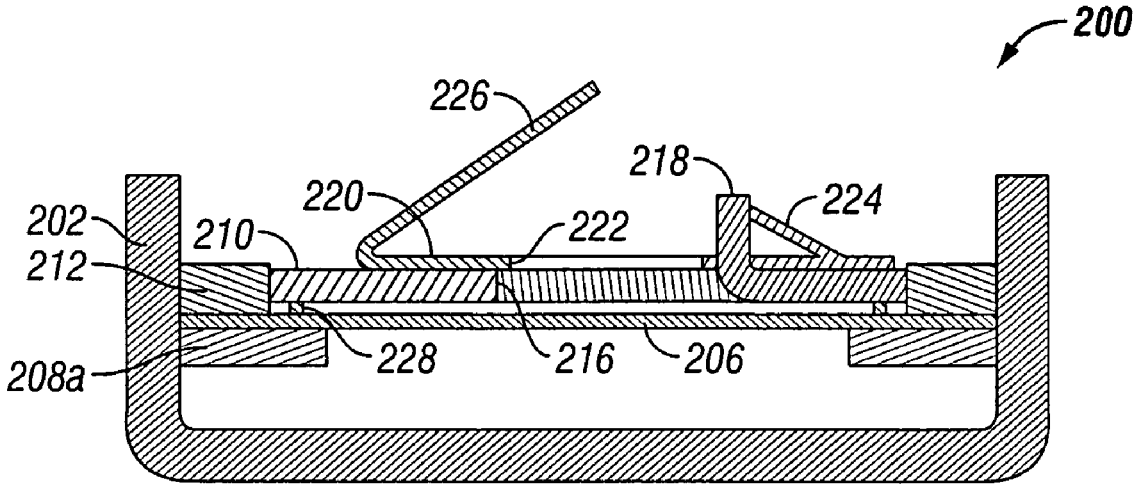

FIGS. 2A-2C illustrate a microphone 200 according to embodiments of the invention. As can be seen in FIG. 2A, the microphone 200 is similar to the microphone 100 shown in FIGS. 1A-1B in that it has a housing 202, an inlet port 204*a* over which a sound inlet (not shown) may be attached. Also present (FIG. 2B) are a diaphragm 206 and a diaphragm support structure 208 for supporting the diaphragm 206. The diaphragm 206 divides the housing 202 of the microphone 200 into a front volume containing the inlet port 204*a* (FIG. 2A), and a rear volume containing a rigid, electrically charged backplate 210. The backplate 210 is supported by a backplate support frame 212 that keeps the backplate 210 centered over the diaphragm 206.

The backplate support frame 212, unlike the plastic or Kapton® damping frame 112 (see FIGS. 1A-1B), is made of an elastomeric material, such as rubber, silicon, and the like. The elastomeric material of the backplate support frame 212 forms a substantially airtight seal around the backplate 210 that helps prevent air from escaping between the backplate support frame 212 and the backplate 210. This allows the frequency response of the microphone 200 to be more precisely controlled, resulting in higher quality and better manufacturing yields. In some embodiments, the elastomeric material of the backplate support frame 212 is sufficiently rigid to keep the backplate 210 substantially parallel to and spaced apart from the diaphragm 206. Alternatively, or in addition, spacers (not expressly shown) may be used in some implementations to keep the backplate 210 substantially parallel to and spaced apart from the diaphragm 206. The spacers may be, for example, Kapton® bumps commonly known to those having ordinary skill in the art, although any type of spacer may be used without departing from the scope of the invention.

In some embodiments, the backplate support frame 212 may be in the form of an O-ring surrounding the outer circumference of the backplate 210. This may be better viewed in FIG. 2B, which is a cross-section of the microphone 200 along line 2B-2B. As can be seen, the O-ring/backplate support frame 212 is flushed against the outer circumference of the backplate 210 to form an airtight seal. Note that the two components are flushed against each other, but do not overlap in this embodiment. In other embodiments, however, it is possible for the backplate 210 to extend under and/or over and/or into the backplate support frame 212 without departing from the scope of the invention. Further, no slits are cut into the inner edges of the backplate support frame 218, since the present invention uses a different mechanism to dampen the frequency response of the microphone 200, discussed below.

In accordance with embodiments of the invention, the backplate 210 has a hole formed therein, defined by an inner wall 216 of the backplate 210. The hole is located in the middle of the backplate 210 and preferably has a generally round shape, although the particular shape and location of the hole is not overly important to the practice of the invention. As such, the hole may be formed using any suitable means, including by poking or lancing the backplate 210. The shape of the hole may then be reworked if needed. The poking or lancing, however, may result in formation of a stub 218 protruding upward from the backplate 210. With prior art microphones, the stub 218 is not used at all and the hole is used merely to facilitate handling of the backplate 210 and is normally filled in afterwards. In the present invention, however, the hole is left opened to help dampen the frequency response of the microphone 200. In some embodiments, the stub 218 is also used, as will be described below.

To control the frequency response of the microphone 200, the amount of air allowed to escape through the hole in the backplate 210 needs to be carefully controlled. Therefore, a foil or cover 220, which may be a metal or plastic cover, is placed over the hole in the backplate 210. The foil or cover 220 may reside on either side of the backplate 210, but is preferably on the side facing away from the diaphragm 206. At least one slit or opening is formed in the foil or cover 220, as defined by the interior wall 222, that is smaller than the hole in the backplate 210. This smaller slit or opening consequently limits the amount of air escaping through the backplate 210 and, hence, the frequency response of the microphone 200. The size, shape, location, and/or number of slits or openings may be determined using any suitable technique known to those having ordinary skill in the art, including by trial and error. The desired amount of frequency response damping may then be achieved by precisely following the determined size, shape, location, and/or number of the slit or opening in the foil or cover 220.

To keep the foil or cover 220 in place on the backplate 210, in some embodiments, a lug 224 may be formed on the foil or cover 220. The lug 224 is then braced against the stub 218 to anchor the foil or cover 220 in place on the backplate 210. Any suitable means may be used to form the lug 224, including by poking or lancing the foil or cover 220. Both the lug 224 and the stub 218 may need to be trimmed for optimal efficacy. It is also possible, for example, to glue or weld the foil or cover 220 to the backplate 210 to secure the foil or cover 220 to the backplate 210. In these latter embodiments, the lug 224 is not needed.

In some embodiments, the foil or cover 220 may further include a clip portion 226 extending from one end of the foil or cover 220 away from the backplate 210 at an upward angle. The upward angle may be less than 90°, in which case the clip portion 226 extends over the foil or cover 220, or it may be greater than 90° (but less than 180°), in which case the clip portion 226 does not extend over the foil or cover 220. In either case, the upward angle of the clip portion 226 gives the foil or cover 220 a spring-like effect, pressing against the other components (e.g., a circuit board) on top of the foil or cover 220 when the housing 202 is closed to keep the foil or cover 220 in place on the backplate 210.

In some embodiments, the clip portion 226 also serves as an electrical contact between the backplate 210 and other components in the microphone 200, like a circuit board (not shown). In existing microphones, some type of electrically conductive wire connects the backplate to the circuit board. The wire carries the electric signals induced in the backplate to the circuit board and is usually attached (e.g., soldered) to the circuit board. In the present invention, however, the electrical contact between the backplate 210 and the circuit board may be provided by the spring-like effect of the clip portion 226 pushing against the circuit board. Preferably, the foil or cover 220 and the clip portion 226 are made of a metallic material that is the same as or similar to the material of the backplate 210 for improved electrical contact.

As mentioned above, spacers may be used to keep the backplate 210 substantially parallel to and spaced apart from the diaphragm 206. FIG. 2C illustrates a cross-section of the microphone 200 in which exemplary spacers 228 (e.g. Kapton® bumps) are used. The spacers 228 are disposed between the backplate 210 and the diaphragm 206, and rest on diaphragm support structures 208*a*, which have been horizontally extended here relative to their counterparts in FIG. 2B. In addition, some embodiments may include standoffs or protrusions (not expressly shown) formed under the diaphragm support structures 208*a* and extending to the floor of the housing 202 for supporting the diaphragm support structures 208*a*.

Although the backplate 210 has been shown and described with a single hole through it, the invention is not to be limited thereto. For example, in one embodiment, it is possible to have multiple holes punched through the backplate 210. Then, at least one slit or opening may be formed in the foil or cover 220 over each hole in the backplate 210, with each slit or opening preferably smaller in size than its corresponding hole. It is also possible, of course, to have a single slit or opening in the cover 220 overlapping multiple holes in the backplate 210 without departing from the scope of the invention.

Figure 3:
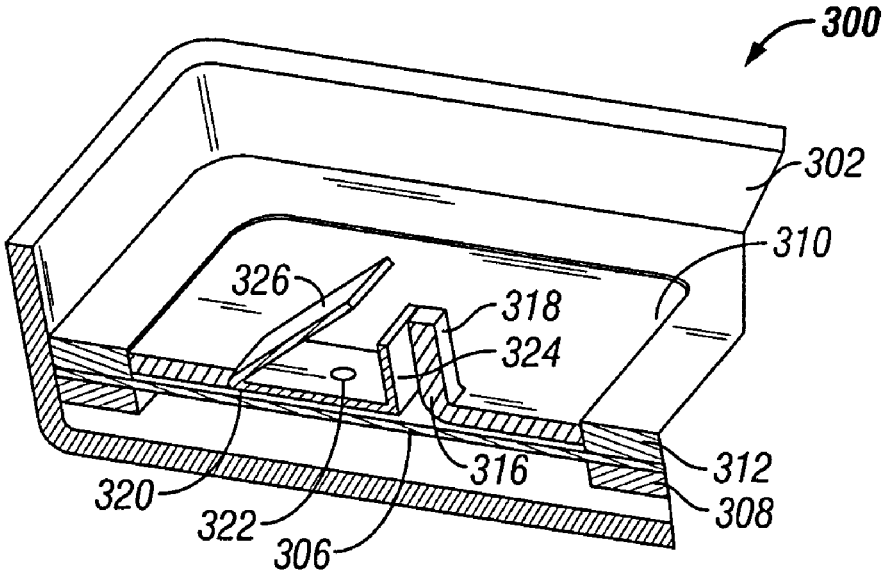
FIG. 3 illustrates another microphone according to some embodiments of the invention.

FIG. 3 is a perspective view of another microphone 300 according to embodiments of the invention. As can be seen, the microphone 300 is essentially identical to the microphone 200 of FIGS. 2A-2C in that it includes a housing 302, a sound inlet (not shown), a diaphragm 306, and a diaphragm support structure 308 for supporting the diaphragm 306. Also present are a rigid, electrically charged backplate 310 and an elastomeric backplate support frame 312 for supporting the backplate 310. The backplate 310 has a hole formed therein, as defined by an inner wall 316 thereof, and a stub 318 adjacent to the hole. A foil or cover 320 having a slit or opening therein, as defined by an interior wall 322, covers the hole in the backplate 310. However, unlike the previous embodiments, the foil or cover 320 here is recessed within the backplate 310 (i.e., co-planar with) instead of residing on the backplate 310. This arrangement allows the foil or cover 320 to be simply snapped into place and may result in more consistent positioning of the foil or cover 320 in the backplate 310.

In some embodiments, the foil or cover 320 may further include a backing 324. The backing 324 may be buttressed against the stub 318 to anchor the foil or cover 320 to the backplate 310. Although not expressly shown, a similar backing 324 may be used to secure the foil or cover 220 in the embodiment of FIGS. 2A-2C (i.e., the backing 324 is not specific to any embodiment).

An upwardly angling clip portion 326, similar to the clip portion 226 of FIGS. 2A-2C, may be provided. As before, the clip portion 326 imparts a spring-like effect to the foil or cover 320 that, in some embodiments, helps maintain electrical contact between the backplate 310 and other components, such as a circuit board (not shown), in the microphone 300.

Advantages of the above embodiments include a single foil or cover 220/320 in a microphone 200/300 that can be used both to control the frequency response of the microphone 200/300 as well as to establish an electrical connection between the backplate 210/310 and other components in the microphone. The electrical connection is established and maintained based on the spring-loaded physical contact 20 (i.e., no wire attachment to the circuit board is necessary), which make it easier to assemble the microphone 200/300. In addition, in some embodiments, the foil or cover 220/320 is also self-anchoring in that it keeps itself secured to the backplate 210/310 by virtue of being spring-loaded.

Moreover, the use of a separate component 220/320 to control the frequency response of the microphone 200/300 allows the microphone to be modular. Thus, the same diaphragm 206/306, backplate 210/310, along with the supporting structures 208/308/212/312 therefor, may be used for all microphones, and only the foil or cover 220/320 need vary. As a result, large variations may occur in the size and/or shape of the hole in the backplate 210/310 without affecting the manufacturability of the microphones. This allows manufacturers to pick and choose the desired level of damping by simply selecting a foil or cover 220/320 with a certain size opening.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A microphone, comprising:

a housing;

a diaphragm mounted in said housing;

a backplate mounted substantially parallel to and spaced apart from said diaphragm, said backplate having at least one hole through said backplate; and a cover contacting a surface portion of said backplate to cover up said at least one hole in said backplate, said cover having at least one opening through said cover, said at least one opening having a predetermined size, shape, and/or location to control a frequency response of said microphone, said at least one opening being smaller than said at least one hole, said cover having a footprint that is less than a footprint of said backplate, wherein said cover includes a clip portion extending away from said backplate at an angle, said clip portion providing a spring-load for said cover.

2. The microphone according to claim 1, further comprising a support frame surrounding a circumference of said backplate, said support frame forming an airtight seal with said backplate.

3. The microphone according to claim 2, wherein said support frame is made of an elastomeric material.

4. The microphone according to claim 3, wherein said elastomeric material includes rubber and silicon.

5. The microphone according to claim 1, wherein said cover resides within said backplate.

6. The microphone according to claim 1, wherein said cover resides on top of said backplate.

7. The microphone according to claim 1, wherein said at least one opening in said cover has a substantially rectangular shape.

8. The microphone according to claim 7, wherein said clip portion provides an electrical connection between said backplate and other components in said microphone.

9. The microphone according to claim 1, wherein said backplate includes a stub protruding from said backplate and said cover includes a lug formed therein, said lug braced against said stub to help keep said cover in place.

10. The microphone according to claim 1, wherein said backplate includes a stub protruding from said backplate and said cover includes a backing formed thereon, said backing buttressed against said stub to help keep said cover in place.

11. The microphone according to claim 1, wherein said cover is adhered to said backplate to help keep said cover in place.

12. The microphone according to claim 11, further comprising a substantially airtight seal around said backplate.

13. The microphone according to claim 11, wherein said cover is wedged on said backplate.

14. The microphone according to claim 11, wherein said cover is fitted into said backplate.

15. The microphone according to claim 1, wherein said cover is welded to said backplate to help keep said cover in place.

16. The microphone according to claim 1, wherein said cover includes a metallic material.

17. The microphone according to claim 1, wherein said cover includes plastic.

18. A microphone, comprising:

a housing;

a diaphragm mounted in said housing;

a backplate mounted in said housing at a known location relative to said diaphragm, said backplate having a hole through said backplate;

an electrical-contact element contacting a surface portion of said backplate for carrying signals from said backplate, said electrical-contact element providing an opening having a predetermined size, shape, and/or location in said electrical-contact element for controlling a frequency response of said microphone, said opening being smaller than said hole, wherein said electrical-contact element includes a clip portion extending away from said backplate at an angle, said clip portion providing a spring-load for said electrical-contact element and an electrical connection between said backplate and other components in said microphone, and wherein said electrical-contact element has a footprint that is less than a footprint of said backplate.

19. The microphone according to claim 18, wherein said predetermined shape of said opening is substantially rectangular.

20. The microphone according to claim 18, wherein said electrical-contact element resides on said backplate.

21. The microphone according to claim 18, wherein said electrical-contact element is recessed into said backplate.

* * * * *